US005749180A

United States Patent [19]

Jewett et al.

[11] Patent Number: 5,749,180

[45] Date of Patent: May 12, 1998

[54] GROUND ANCHOR

[75] Inventors: Thomas E. Jewett, Morrison; Thomas B. Bird, Westminster, both of Colo.

[73] Assignee: Asset Purchase Co. LLC, Commerce City, Colo.

[21] Appl. No.: 742,201

[22] Filed: Oct. 31, 1996

[51] Int. Cl.[6] ..... E02D 5/80

[52] U.S. Cl. ..... 52/154; 52/156; 52/165

[58] Field of Search ..... 52/153–156, 158, 52/159, 165, 166, 170

[56] References Cited

U.S. PATENT DOCUMENTS

| | | | |
|---|---|---|---|
| 4,320,608 | 3/1982 | Deike | 52/165 |
| 4,553,358 | 11/1985 | Deike | 52/98 |
| 4,615,156 | 10/1986 | Deike | 52/153 X |
| 5,226,829 | 7/1993 | Jones | 52/166 X |

*Primary Examiner*—Robert Canfield
*Attorney, Agent, or Firm*—Hill, Steadman & Simpson

[57] ABSTRACT

A ground anchor for securing posts in the ground is provided. The ground anchor comprises a leg having a lower portion that is connected to a barb and an upper portion that is connected to a fin structure. The leg further comprises two sidewalls that meet at a corner and terminate at two diverging ends. The lower barb extends upward from the lower portion of the leg at a non-vertical angle. The barb provides additional resistance to any uplifting forces imposed upon the post or the anchor and further displaces or clears out soil from beneath the fin structure to facilitate the insertion of the post therethrough. The fin structure comprises a central crease portion disposed between two diverging fins. The fin structure is attached to the leg so that the central crease is disposed opposite to the corner of the leg. Each of the diverging fins are connected to one of the diverging ends of the sidewalls of the upper portion of the leg. A socket is formed between the crease and diverging fins of the fin structure and the corner and sidewalls of the leg structure. After the ground anchor is driven into the ground, the post is driven through the socket area. The soil or ground is then tamped around the post before a wedge is driven between the crease portion of the fin structure and the post. In addition to or instead of the barb structure, a rod connecting the lower end of the fin structure to the leg may be utilized to break up or displace the soil disposed underneath the socket as the ground anchor is driven into the ground.

19 Claims, 3 Drawing Sheets

GROUND ANCHOR

BACKGROUND OF THE INVENTION

This invention relates to ground anchors, and more specifically to anchors for securing a post, such as a sign post or a fence post or a mailbox support post in the ground.

Ground anchors are known. Specifically, U.S. Pat. No. 4,320,608, incorporated herein by reference and commonly owned with the present application, discloses a ground anchor 10 as shown in FIG. 1 which features a downwardly extending leg 11 that is attached to a V-shaped wing or fin structure 17. The leg 11 is preferably fabricated from angle iron. The V-shaped wing 17 is attached to the leg so that the inside surfaces of the fin structure 17 are attached to the ends 15, 16 of the leg 11 and further so that the crease or corner portion 18 of the V-shaped wing 17 is disposed opposite to the corner 12 of the leg 11. The space between the leg 11 and the wing structure 17 forms a socket through which the post is driven. A wedge structure (not shown in FIG. 1) is also utilized which is driven between the post (not shown) and the wing structure 17 which forces the post against the leg 11.

The first step in utilizing the invention disclosed in U.S. Pat. No. 4,320,608 involves driving the ground anchor into the ground. A problem arises because there is no structure or means for loosening or displacing any of the soil disposed beneath the socket of the ground anchor where the post will be driven. Consequently, the ground anchor is driven into the ground and firm, packed soil remains disposed within the socket area. This condition makes it difficult to drive the post through the socket area. Further, this condition also complicates the driving of the wedge between the post and the wing structure.

Further, it will be seen from U.S. Pat. No. 4,320,608 that the leg structure is straight and free of protrusions, consequently, after periods of vibration or swaying of the post back and forth, the leg can become loose within the ground. As a result, the post and the leg become wobbly rendering the entire structure vulnerable to removal by vandals.

Accordingly, there is a need for an improved ground anchor for anchoring posts in the ground that makes it easier to drive the post into the ground after the ground anchor is in place. Further, there is a need for an improved ground anchor with increased stability after it is in place which will result in a more durable anchoring of the post.

SUMMARY OF THE INVENTION

The above problems have been addressed by the present invention which provides a ground anchor comprising a downwardly extending leg. The lower portion of the leg is connected to a barb which extends upwardly at an angle from the vertical. An upper portion of the leg is connected to a fin structure. The leg is preferably in the form of a piece of angle iron or a similar structure comprising two sidewalls that meet at a corner and terminate at two diverging ends. The lower barb attached to the lower portion of the leg is also preferably a piece of angle iron.

The fin structure comprises a central crease or corner section disposed between two diverging fins. The fin structure is attached to the leg so that the crease is disposed opposite to the corner of the leg. The diverging fins are then connected to the diverging ends of the sidewalls of the leg in order to form a socket disposed between the crease and the diverging fins of the fin structure and the corner and sidewalls of the leg structure.

In a preferred embodiment, the lower barb is in alignment with the socket area. By positioning the lower barb in alignment with the socket area, the lower barb disrupts and displaces soil underneath the socket area as the ground anchor is being driven into the ground. By disrupting and displacing soil underneath the socket area, the driving of the post to the socket area is greatly facilitated.

In an alternative embodiment, the ground anchor includes a rod which connects a lower end of the wing structure to the leg. The rod, like the barb, acts to disrupt and displace the soil as the ground anchor is being driven into the ground. The rod may be included instead of the barb or in addition to the barb. When the rod is included in addition to the barb, the barb is disposed on the leg below the point where the rod is connected to the leg.

In an embodiment, an upper barb is disposed between the fin structure and the lower barb.

In an embodiment, an upper barb is disposed between the fin structure and the lower barb, both the upper barb and lower barb being in alignment with the socket area.

In an embodiment, a second lower barb is disposed on an opposing side of the leg from the lower barb thereby providing two oppositely directed, upwardly extending barbs.

In an embodiment, the ground anchor of the present invention comprises three barbs, two lower barbs and an upper barb.

In an embodiment, the fin structure of the present invention comprises two widely divergent fins extending outward from the diverging fins at a wider angle than said diverging fins.

In an embodiment, the non-vertical angle at which the barb extends ranges from about 10° to about 50° from the vertical.

In an embodiment, the non-vertical angle at which the barb extends is approximately 30° from the vertical.

In an embodiment, the barb or barbs range in length from about 2" to about 6".

In an embodiment, the barb is about 4" long.

In an embodiment, the ground anchor of the present invention further comprises a wedge. The wedge comprising an elongated hollow structure having a concave wall for engaging the post and a convex wall for engaging the crease of the fin structure. The wedge being driven between the post and the crease of the fin structure.

In an embodiment, the present invention provides a method of anchoring a post into the ground. The method comprising the steps of driving a ground anchor into the ground, the ground anchor comprising the leg that is connected to a lower barb at a lower portion thereof and an upper portion that is connected to a fin structure. The fin structure comprising a crease disposed between two diverging fins. The fin structure and the leg forming a socket for receiving a post. The method of the present invention also includes the step of displacing at least a portion of the ground disposed beneath the socket with the lower barb as the ground anchor is driven into the ground, driving the post through the socket, tamping the ground adjacent to the post and driving a wedge into the socket between the post and the ground anchor.

In an embodiment, the step of displacing the ground beneath the socket includes the use of a rod which connects a lower portion of the fin structure to the leg instead of or in addition to the use of the barb structure.

In an embodiment, the driving step of the method of the present invention comprises driving the wedge between the post and the fin structure.

In an embodiment, the present invention provides a method of manufacturing an improved ground anchor comprising the steps of providing a leg comprising a lower portion and an upper portion, the leg comprising two sidewalls that meet at a corner and terminate at two diverging ends. The method further comprises the step of attaching a lower barb to the lower end of the leg so that the lower barb extends upward at a non-vertical angle. The method further comprises the step of attaching a fin structure comprising a central crease disposed between two diverging fins to the leg so that each of said diverging fins is connected to one of said diverging ends of said sidewalls of said leg at an upper portion of the leg to form a socket between the crease and diverging fins of the fin structure and the corner and sidewalls of the leg structure.

In an embodiment, the method of manufacturing of the present invention further comprises the step of attaching the lower barb to the lower portion of the leg so that the lower barb is in alignment with the socket.

In an embodiment, the method of manufacturing the present invention further comprises attaching a rod between the lower end of the fin structure and the leg.

It is therefore an advantage of the present invention to provide an improved ground anchor which features a means for displacing and/or disrupting soil so that the insertion of the post through the ground anchor is facilitated.

Another advantage of the present invention is to provide an improved ground anchor which compresses and strengthens the soil at a lower portion of the ground anchor and underneath the ground anchor thereby adding frictional resistance to any uplifting forces imposed upon the post and the ground anchor.

Another advantage of the present invention is improved uplift resistance during vehicle impact.

Another advantage of the present invention is that it provides improved resistance to forces along the direction defined by the corner of the leg and the crease of the fin structure.

Another advantage of the present invention is that it provides an improved method of anchoring a post in the ground.

Yet another advantage of the present invention is that it provides an improved method of manufacturing a ground anchor.

Other advantages and objects of the invention will become apparent upon reading the following detailed description and appended claims, and upon reference to the accompanying drawings.

BRIEF DESCRIPTION OF THE DRAWINGS

For a more complete understanding of the present invention, reference should now be made to the embodiments illustrated in greater detail in the accompanying drawings and described below by way of examples of the present invention.

It should be understood that the drawings are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted. It should be understood, of course, that the invention is not necessarily limited to the particular embodiments illustrated herein.

DETAILED DESCRIPTION OF THE PREFERRED EMBODIMENTS

Figure 1:
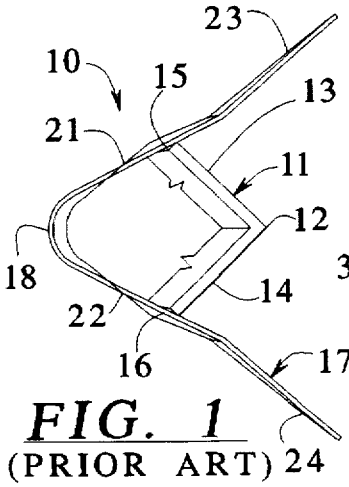
FIG. 1 (PRIOR ART)
FIG. 1 is a top view of a prior art ground anchor.

FIG. 1 is a top view of a ground anchor 10 similar to that shown and described in U.S. Pat. No. 4,320,608. The ground anchor 10 may be used for sign posts, fence posts, mailbox support posts or in other instances where a post which is planted into the ground is in need of structural or anchoring support. The ground anchor includes a leg 11 which is preferably fabricated from a piece of angle iron. The leg 11 features a corner 12 disposed between two diverging sidewalls 13, 14. The ends 15, 16 of the sidewalls 13, 14 are attached to inside surfaces of the fin structure 17. The fin structure 17 features a crease or corner section 18 disposed between two diverging fins 21, 22. The diverging fins 21, 22 are connected to wider diverging fins 23, 24 respectively.

Figure 2:
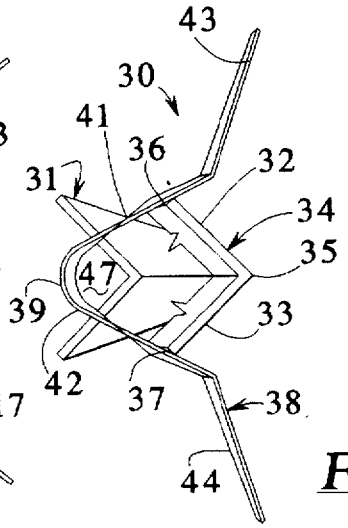
FIG. 2 is a top view of a ground anchor fabricated in accordance with the present invention.

In contrast, as shown in FIG. 2, the ground anchor 30 as shown in FIG. 2 features a barb structure 31. The barb structure 31 is connected to the walls 32, 33 of the leg 34 as well as the corner 35. The ends 36, 37 of the walls 32, 33 of the leg 34 are connected to the fin structure shown at 38. The fin structure 38 also includes a corner or crease portion 39 disposed between two diverging fins 41, 42. However, the diverging fins 41, 42 are connected to wider diverging fins 43, 44. It will be noted that the wider diverging fins 43, 44 extend outward at a wider angle from each other than the fins 23, 24 of the prior art structure 10 shown in FIG. 1. The wider angle of the fins 43, 44 provides improved resistance to forces exerted along the direction defined by the crease 39 and corner 35. Accordingly, it is preferred that the fins 43, 44 be disposed at a somewhat perpendicular position to anticipated forces, such as oncoming traffic or strong winds. In the preferred embodiment, the crease 39 of the fin structure 38 is directed toward oncoming traffic, or the direction the sign 49 faces, and the corner 35 of the leg 34 is directed away from oncoming traffic, or away from the direction the sign 49 faces, as illustrated in FIGS. 3 and 4.

Figure 3:
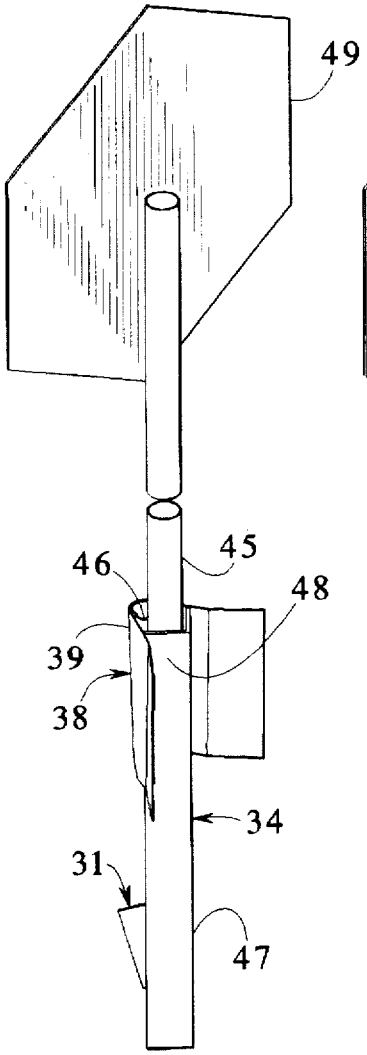
FIG. 3 is a rear perspective view of the ground anchor first shown in FIG. 2 as installed around a sign post.
Figure 4:
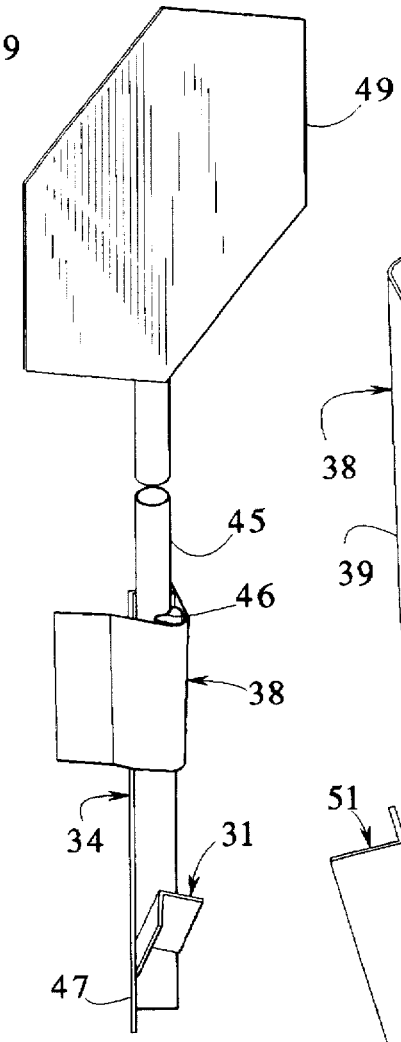
FIG. 4 is a front perspective view of the ground anchor of FIG. 2 as installed around a sign post.

As illustrated in FIG. 3, the post 45 is inserted through the space disposed between the leg 34 and fin structure 38. The space which accommodates the post 45 and the wedge 46 will hereinafter be referred to as a socket and is shown at 47 in FIG. 2. The barb structure 31 is attached to a lower end 47 of the leg 34. In contrast, the fin structure 38 is attached to an upper end 48 of the leg 34. The wedge 46 is disposed between the crease 39 and the pole or post 45. The purpose of the wedge 46 is to insure a tight frictional fit between the post 45 and the walls 32, 33 of the leg 34. The barb structure 31 is directed upward at an angle from vertical. While the angle from vertical may vary from 10° to 50°, one presently preferred angle is approximately 30°.

Figure 5:
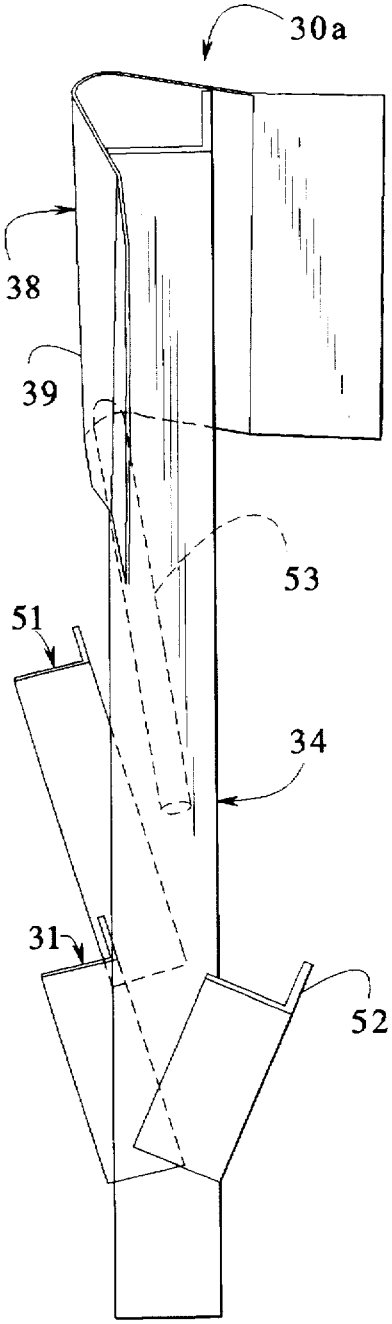
FIG. 5 is a rear perspective view of an alternative embodiment of a ground anchor made in accordance with the present invention.

FIG. 5 illustrates an alternative embodiment of the present invention. Specifically, as opposed to a single anchor 31, an upper anchor 51 and a lower rear anchor 52 is provided. The lower rear anchor 52, like the lower front anchor 31, provides resistance to uplifting forces. Similarly, the upper front anchor 51 also provides resistance to uplifting forces and further helps displace and dislodge soil as the anchor 30*a* is being driven into the ground. Another feature illustrated in FIG. 5 is the rod 53 which extends downward from the crease corner area 39 of the fin structure 38 to the leg 34. The rod 53 also displaces and dislodges soil to facilitate the insertion of the post 45. The rod 53 may be used in addition to, or instead of, the barb structures 31, 51, 52.

Figure 6:
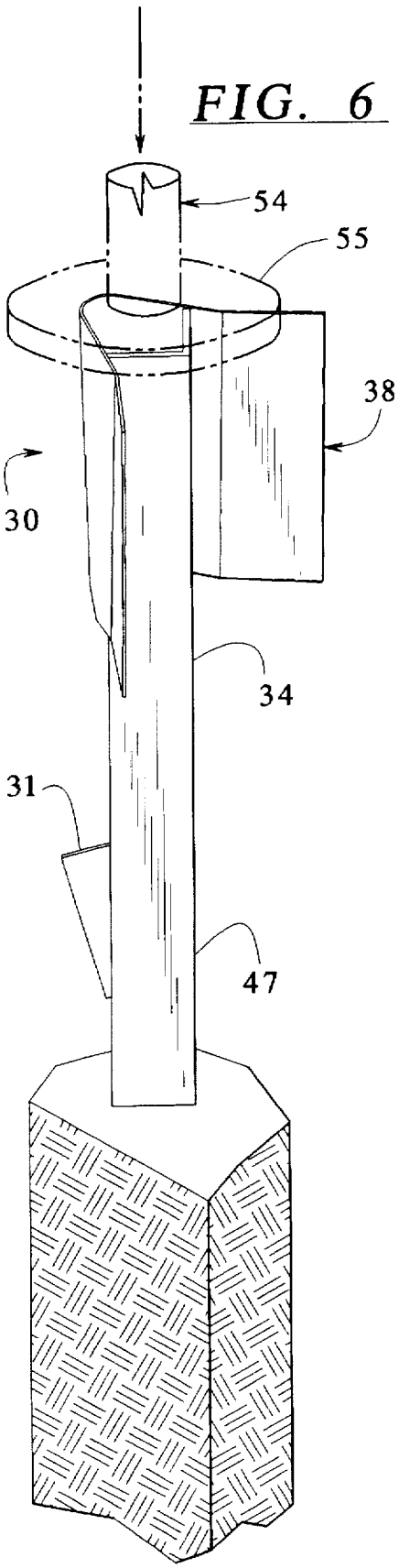
FIG. 6 is a rear perspective view of the ground anchor first shown in FIG. 2 as it is being driven into the ground.
Figure 7:
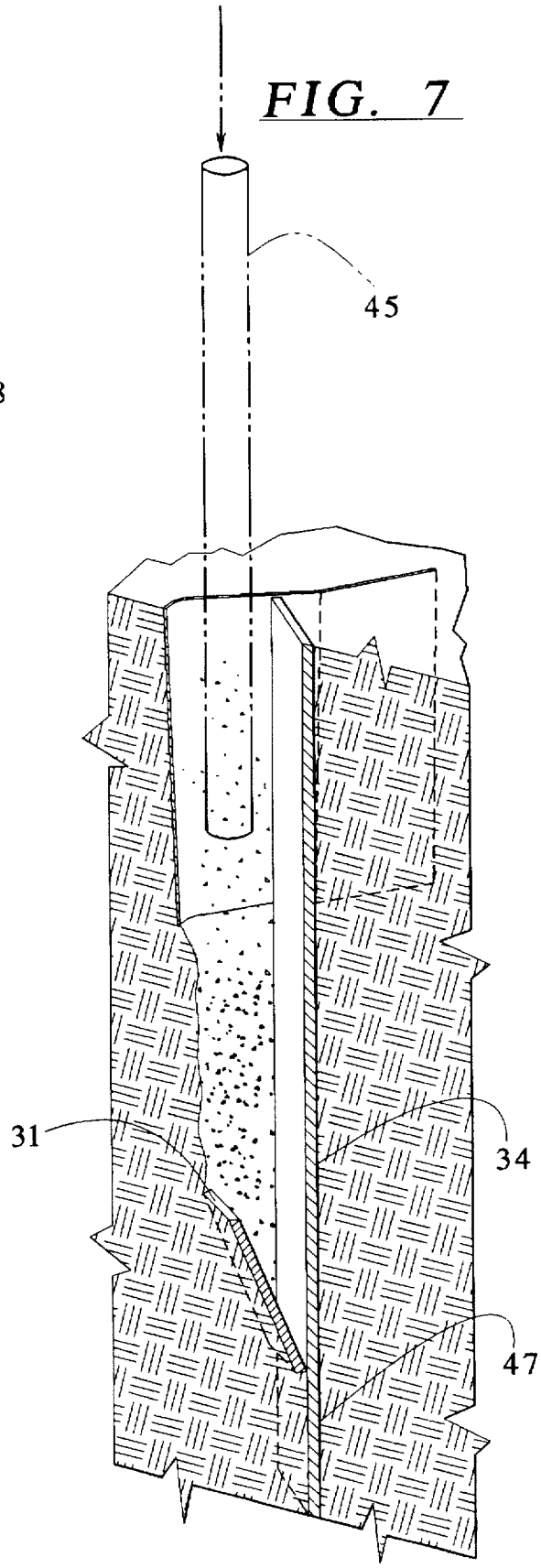
FIG. 7 is a side sectional view of the ground anchor first shown in FIG. 2 as installed in the ground and during the insertion of a sign post therethrough.
Figure 8:
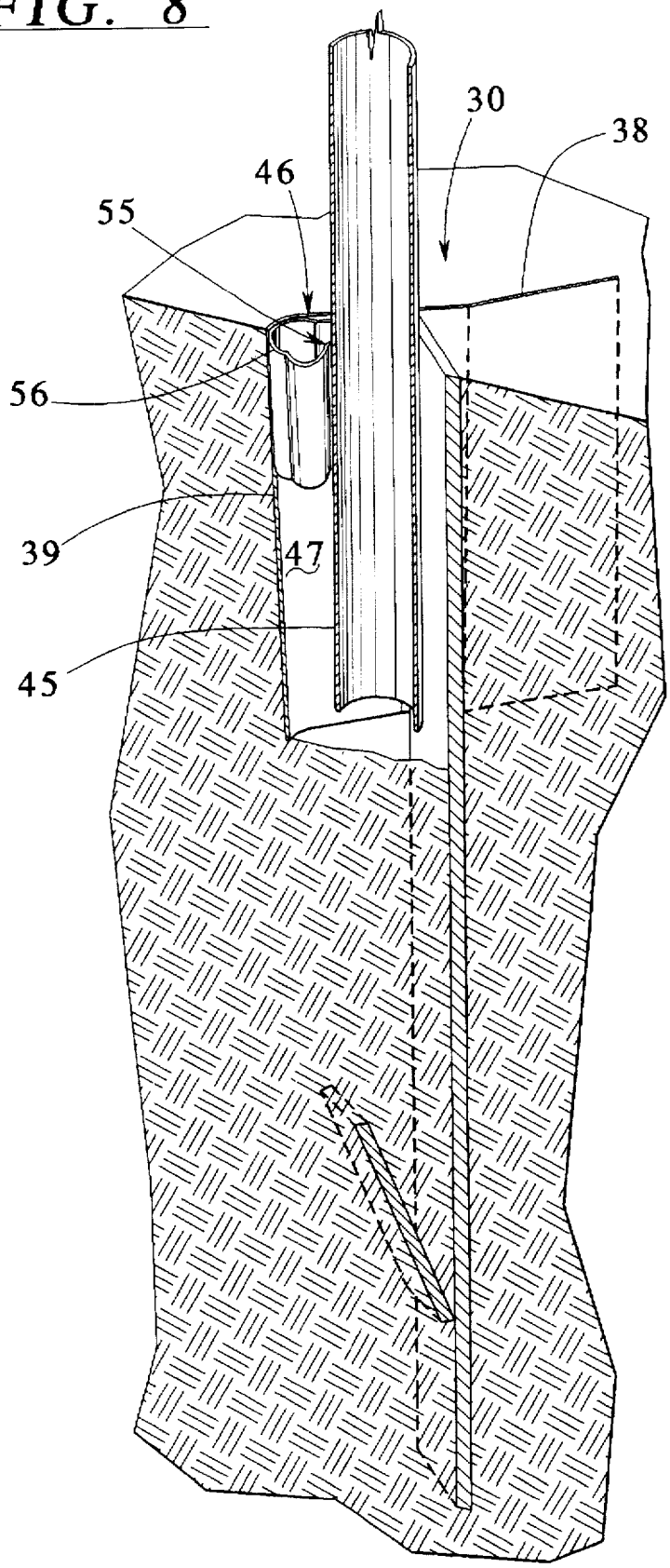
FIG. 8 is a sectional view of the ground anchor first shown in FIG. 2, with a sign post inserted therein and with a wedge disposed between the fin structure of the ground anchor and the sign post.

The method of inserting the anchor 30 into the ground and post 45 within the anchor is illustrated in FIGS. 6, 7 and 8. As illustrated in FIG. 6, an insertion tool 54 with a wide head 55 is used to apply force to the top of the fin structure 38 and leg 34. The lower end 47 of the leg 34 is driven into the ground. As the leg 34 penetrates the ground, the barb 31 displaces dirt and soil out from underneath the socket area 47 as illustrated in FIG. 7. By displacing soil from underneath the socket area 47, the insertion of the post 45 through the socket area is greatly facilitated. Further, the barb 31 also acts to compact soil underneath the barb 41 and toward the lower end 47 of the leg 34 to insure a firm implantment of the leg 34 into the ground. Additionally, the barb 31 resists any uplifting forces applied to the ground anchor 30 and post 45. After the post 45 has been inserted into place, the ground is tamped with an appropriate tamping tool. After the ground is sufficiently tamped, a wedge 46 is driven into the remaining socket area 47 disposed between the post 45 and the corner 39 of the fin structure 38. Preferably, the wedge 46 is an elongated hollow structure with a concave or creased surface shown at 55 for engaging the round post 45. In addition, the wedge 46 should preferably include a convex surface 56 for engaging the corner 39 of the fin structure 38.

As noted above, the preferred material for fabricating the leg 34 is 2"×2"×¼" angle iron. Of course, angle iron of other dimensions may be used and other strip metals may be used such as aluminum or steel. The rod 53 may be fabricated from iron or another suitable material. The thickness or diameter of the rod 53 should range from ¼" to 1", preferably about ½". The rod 53 may also be fabricated from a flat piece of iron or other suitable material or a piece of angle iron. The preferred material for fabricating the fin structure is sheet metal of 10 or 12 gauge. The specification and sizes listed in U.S. Pat. No. 4,320,608 should be generally followed. However, the improvements provided by the present invention will result in a substantially stronger structure. Accordingly, if a vehicle hits the post 45, it will easily snap off thereby resulting in a reduced amount of damage imparted to the oncoming vehicle.

From the above description, it is apparent that the advantages and objects of the present invention have been achieved. While only certain embodiments have been set forth herein, alternative embodiments and various modifications will be apparent to those skilled in the art. It should be apparent that such modifications and alternatives are considered equivalents within the spirit and scope of the present invention.

What is claimed is:

1. A ground anchor comprising:

a leg comprising a lower portion that is connected to a lower barb and an upper portion that is connected to a fin structure, the leg further comprising two sidewalls that meet at a corner and terminate at two diverging ends, the lower barb extending upward from the lower portion of the leg at a non-vertical angle, the fin structure comprising a central crease disposed opposite to the corner of the leg and between two diverging fins, each of said diverging fins connected to one of said diverging ends of said sidewalls at the upper portion of the leg to form a socket between the crease and diverging fins of the fin structure and the corner and sidewalls of the leg, said lower barb providing a means for displacing soil from the socket as the ground anchor is driven into the ground.

2. The ground anchor of claim 1 wherein the lower barb is in alignment with the socket.

3. The ground anchor of claim 1 wherein the ground anchor further comprises an upper barb disposed between the fin structure and the lower barb.

4. The ground anchor of claim 3 wherein the upper barb and lower barb are in alignment with the socket.

5. The ground anchor of claim 1 wherein the ground anchor further comprises a second lower barb disposed on an opposing side of the leg from the lower barb.

6. The ground anchor of claim 1 wherein the ground anchor further comprising a second lower barb disposed on an opposing side of the leg from the lower barb and an upper barb disposed between the fin structure and the lower barb.

7. The ground anchor of claim 1 wherein the fin structure further comprises widely divergent fins extending outward from the diverging fins.

8. The ground anchor of claim 1 wherein the non-vertical angle ranges from about 10° to about 50° from vertical.

9. The ground anchor of claim 1 wherein the ground anchor further comprises a rod connecting a lower end of the crease to the leg.

10. The ground anchor of claim 1 further comprising a wedge, the wedge comprises an elongated hollow structure having a concave wall and a convex wall, the convex wall for engaging the crease of the fin structure.

11. A method anchoring a post into the ground comprising the following steps:

driving a ground anchor into the ground, the ground anchor comprising a leg that is connected to a lower barb and an upper portion that is connected to a fin structure, the fin structure and leg forming a socket for receiving the post, the lower barb being in alignment with the socket, displacing at least a portion of the ground disposed beneath the socket with the lower barb as the ground anchor is driven into the ground, driving the post through the socket, tamping the ground adjacent to the post, driving a wedge into the socket between the post and the ground anchor.

12. The method of claim 11 wherein the driving step further comprises driving the wedge between the post and the fin structure.

13. The method of claim 12 wherein the wedge comprises an elongated hollow structure having a concave wall and a convex wall, the concave wall for engaging the post, the convex wall for engaging the crease of the fin structure.

14. A ground anchor comprising:

a leg an upper portion that is connected to a fin structure, the leg further comprising two sidewalls that meet at a corner and terminate at two diverging ends, the fin structure comprising a central crease disposed opposite to the corner of the leg and between two diverging fins, each of said diverging fins connected to one of said diverging ends of said sidewalls at the upper portion of the leg to form a socket between the crease and diverging fins of the fin structure and the corner and sidewalls of the leg.

means for displacing soil from the socket as the ground anchor is driven into the ground.

15. The ground anchor of claim 14 wherein said means for displacing soil comprises a the lower barb attached to a lower end of the leg, the lower barb extending upward from the lower portion of the leg at a non-vertical angle.

16. The ground anchor of claim 15 wherein the non-vertical angle ranges from about 10° to about 50° from vertical.

17. The ground anchor of claim 15 wherein the lower barb is in alignment with the socket.

18. The ground anchor of claim 14 wherein the fin structure further comprises widely divergent fins extending outward from the diverging fins.

19. The ground anchor of claim 14 wherein said means for displacing soil comprises a rod connecting a lower end of the crease to the leg.

* * * * *